US005814111A

United States Patent [19]

Graham et al.

[11] Patent Number: 5,814,111

[45] Date of Patent: Sep. 29, 1998

[54] GASOLINE COMPOSITIONS

[75] Inventors: Joseph Graham, Katy, Tex.; Cornelis Van Es, Adisham, United Kingdom

[73] Assignee: Shell Oil Company, Houston, Tex.

[21] Appl. No.: 693,693

[22] Filed: Aug. 6, 1996

Related U.S. Application Data

[63] Continuation of Ser. No. 403,536, Mar. 14, 1995, abandoned.

[51] Int. Cl.[6] ..... C10L 1/18; C10L 1/22

[52] U.S. Cl. ..... 44/443; 44/331; 585/10; 585/14

[58] Field of Search ..... 44/443, 331; 585/3, 585/10, 14

[56] References Cited

U.S. PATENT DOCUMENTS

| | | |
|---|---|---|
| 2,459,112 | 1/1949 | Oberright . |
| 2,812,342 | 11/1957 | Peters . |
| 2,962,442 | 11/1960 | Andress, Jr. . |
| 2,984,550 | 5/1961 | Chamot . |
| 3,036,003 | 5/1962 | Verdol . |
| 3,110,673 | 11/1963 | Benoit, Jr. . |
| 3,166,516 | 1/1965 | Kirkpatrick et al. . |
| 3,172,892 | 3/1965 | Le Suer et al. . |
| 3,216,936 | 11/1965 | Le Suer . |
| 3,219,666 | 11/1965 | Norman et al. . |
| 3,236,770 | 2/1966 | Matson et al. . |
| 3,243,481 | 3/1966 | Ruffing et al. . |
| 3,250,715 | 5/1966 | Wyman . |
| 3,251,853 | 5/1966 | Hoke . |
| 3,260,671 | 7/1966 | Trites et al. . |
| 3,272,746 | 9/1966 | Le Suer et al. . |
| 3,275,554 | 9/1966 | Wagenaar . |
| 3,310,492 | 3/1967 | Benoit, Jr. . |
| 3,326,801 | 6/1967 | Schlobohm et al. . |
| 3,337,459 | 8/1967 | Ford . |
| 3,341,542 | 9/1967 | Le Suer et al. . |
| 3,355,270 | 11/1967 | Amick et al. . |
| 3,356,763 | 12/1967 | Dollinger et al. . |
| 3,368,972 | 2/1968 | Otto . |
| 3,405,064 | 10/1968 | Miller . |
| 3,413,347 | 11/1968 | Worrel . |
| 3,429,674 | 2/1969 | Hoke . |
| 3,438,757 | 4/1969 | Hounen et al. . |
| 3,442,808 | 5/1969 | Traise et al. . |
| 3,444,170 | 5/1969 | Norman et al. . |
| 3,448,047 | 6/1969 | Traise et al. . |
| 3,454,497 | 7/1969 | Wittner . |
| 3,454,555 | 7/1969 | van der Voort et al. . |
| 3,455,831 | 7/1969 | Davis . |
| 3,455,832 | 7/1969 | Davis . |
| 3,459,661 | 8/1969 | Schlobohm . |
| 3,461,172 | 8/1969 | Previc . |
| 3,468,639 | 9/1969 | Lindstrom et al. . |
| 3,475,514 | 10/1969 | Nemphos et al. . |
| 3,493,520 | 2/1970 | Verdol et al. . |
| 3,522,179 | 7/1970 | Le Suer . |
| 3,539,633 | 11/1970 | Piasek et al. . |
| 3,558,743 | 1/1971 | Verdol et al. . |
| 3,565,804 | 2/1971 | Honnen et al. . |
| 3,576,743 | 4/1971 | Widmer et al. . |
| 3,586,629 | 6/1971 | Otto et al. . |
| 3,591,598 | 7/1971 | Traise et al. . |
| 3,600,372 | 8/1971 | Udelhofen et al. . |
| 3,630,904 | 12/1971 | Musser et al. . |
| 3,632,511 | 1/1972 | Liao . |
| 3,634,515 | 1/1972 | Piasek et al. . |
| 3,649,229 | 3/1972 | Otto . |
| 3,649,659 | 3/1972 | Otto et al. . |
| 3,658,494 | 4/1972 | Dorer, Jr. ..... 44/331 |
| 3,687,849 | 8/1972 | Abbott . |
| 3,687,905 | 8/1972 | Dorer . |
| 3,697,574 | 10/1972 | Piasek et al. . |
| 3,723,575 | 3/1973 | Kern et al. . |
| 3,741,896 | 6/1973 | Abbott et al. . |
| 3,755,433 | 8/1973 | Miller et al. . |
| 3,804,763 | 4/1974 | Meinhardt . |
| 3,822,209 | 7/1974 | Knapp et al. . |
| 3,857,791 | 12/1974 | Marcellis et al. . |
| 3,891,721 | 6/1975 | Prudence . |
| 3,901,665 | 8/1975 | Polss . |
| 4,026,167 | 5/1977 | Archer . |
| 4,077,893 | 3/1978 | Kiovsky . |
| 4,085,055 | 4/1978 | Durand et al. . |
| 4,141,847 | 2/1979 | Kiovsky . |
| 4,160,739 | 7/1979 | Stambaugh et al. . |
| 4,181,618 | 1/1980 | Durand et al. . |
| 4,234,435 | 11/1980 | Meinhardt et al. . |
| 4,346,193 | 8/1982 | Warfel . |
| 4,358,565 | 11/1982 | Eckert . |
| 4,402,844 | 9/1983 | Trepka . |
| 4,409,120 | 10/1983 | Martin . |
| 4,476,283 | 10/1984 | Andersen . |
| 4,477,261 | 10/1984 | Sung . |
| 5,006,130 | 4/1991 | Aiello et al. ..... 44/443 |

FOREIGN PATENT DOCUMENTS

| | | |
|---|---|---|
| 0 290 088 | 11/1988 | European Pat. Off. . |
| 0290088 | 11/1988 | European Pat. Off. . |
| 0 384 605 | 8/1990 | European Pat. Off. . |
| 0 526 129 | 2/1993 | European Pat. Off. . |
| WO 85/00620 | 2/1985 | WIPO . |
| WO 91/05377 | 4/1991 | WIPO . |

OTHER PUBLICATIONS

M. Campen et al., "Growing Use of Synlubes," *Hydrocarbon Processing,* Feb. 1982, pp. 75–82.

*Primary Examiner*—Sharon Gibson
*Assistant Examiner*—Cephia D. Toomer

[57] ABSTRACT

The present invention provides a gasoline composition comprising a major amount of a gasoline suitable for use in spark-ignition engines, a minor amount of a polyalphaolefin having a viscosity at 100° C. from about $2\times10^{-6}$ $m^2/s$ to about $2\times10^{-5}$ $m^2/s$ (2 to 20 centistokes), being a hydrogenated oligomer containing from 18 carbon atoms to 80 carbon atoms derived from at least one alphaolefinic monomer containing from 8 carbon atoms to 16 carbon atoms, and a minor amount of a polyoxyalkylene compound selected from glycols, mono- and diethers thereof, having number average molecular weight ($M_n$) from about 400 to about 3000, the weight ratio of polyalphaolefin:polyoxyalkylene compound being from about 1:10 to about 10:1 and a concentrate for the preparation of such gasoline compositions.

11 Claims, No Drawings

GASOLINE COMPOSITIONS

This is a continuation of application Ser. No. 08/403,536, filed Mar. 14, 1995, now abandoned.

FIELD OF THE INVENTION

The present invention relates to gasoline compositions comprising a major amount of a gasoline suitable for use in spark-ignition engines and a minor amount of one or more additives. The present invention further relates to additive concentrates suitable for use in gasoline compositions.

BACKGROUND OF THE INVENTION

EP-A-290 088 discloses gasoline compositions comprising a major amount of a gasoline suitable for use in spark-ignition engines, and a minor amount of a polyalphaolefin having a viscosity at 100° C. from $2\times10^{-6}$ to $2\times10^{-5}$ $m^2/s$ (2 to 20 centistokes), preferably a hydrogenated oligomer containing 18 to 80 carbon atoms derived from an alphaolefinic monomer containing from 8 to 12 carbon atoms, and optionally minor amounts of an oil-soluble aliphatic polyamine and/or an alkali metal or alkaline-earth metal salt of a succinic acid derivative having a polyolefin substituent on at least one of its carbon atoms and/or a polyolefin derived from a $C_2$ to $C_6$ monomer having a number average molecular weight ($M_n$) between 500 and 1500.

U.S. Pat. No. 3,901,665 discloses liquid hydrocarbon fuel compositions characterized by improved anti-icing and carburetor detergency comprising a. a major amount of a liquid hydrocarbon fuel comprising hydrocarbons boiling in the gasoline range, and based on the weight of said fuel, b. about from 0.01 to about 0.06 percent by weight of a 3- or 4-carbon olefin, preferably polyisobutylene, having a molecular weight of from about 400 to about 1400, preferably about 400 to about 900, and c. from about 0.008 to about 0.016 percent by weight of a polyoxyalkylene compound of the formula $$R(OCH_2\overset{CH_3}{CH})_xOH$$

wherein R is alkyl of 1 to 20 carbon atoms, preferably 10 to 18 carbon atoms, and x has an average value of 4 to 20; and additive compositions consisting essentially of (b) and (c).

U.S. Pat. No. 3,658,494 discloses fuel compositions comprising a major amount of at least one normally liquid fuel and a minor amount of an additive combination soluble in said fuel, the additive combination comprising (a) at least one oxy compound which is a monoether of a glycol or polyglycol and (b) at least one fuel-soluble dispersant selected from the class consisting of esters, amides, imides, amidines, and amine salts of at least one substantially saturated carboxylic acid characterized by the presence within the acyl radical thereof of at least 30 aliphatic carbon atoms, the weight ratio of oxy compound to dispersant being about 0.1:1 to about 1:0.1, but preferably 0.1:1 to about 2.5:1. In the examples the oxy compounds used are ethylene glycol mono-n-butyl ether, dipropylene glycol monomethyl ether, triethylene glycol monoethyl ether, and ethylene glycol monophenyl ether.

EP-A-384 605 discloses a motor fuel composition which comprises a mixture of hydrocarbons boiling in the gasoline boiling range and additionally (1) the reaction product of a defined hydrocarbyl-substituted dibasic acid and a defined polyoxyalkylene diamine, (ii) a polymeric component which is a polyolefin polymer, copolymer, or the corresponding aminated or hydrogenated polymer or copolymer, or mixtures thereof, of a $C_{2-10}$ hydrocarbon, said polyolefin polymer or copolymer having a molecular weight in the range of 500 to 10,000; (iii) a polyalkylene glycol having a molecular weight in the range of 500–2000; and (iv) a lubricating oil. In relation to (ii) it is stated (page 9, lines 39, 40) in general the olefin monomers from which the polyolefin polymer component is prepared are preferably unsaturated $C_{2-6}$ hydrocarbons. The polyalkylene glycol (iii) is said (page 10, lines 39, 40) preferably to be selected from the group consisting of polyethylene glycol, polypropylene glycol and polybutylene glycol.

EP-A-526129 (published on 3 Feb. 1993) discloses a fuel additive concentrate for controlling octane requirement increase in internal combustion engines comprising the reaction product of (i) polyamine and (ii) at least one acyclic hydrocarbyl substituted succinic acylating agent, and an unhydrotreated poly-alpha-olefin. While EP-A-526 129 further and more specifically provides a fuel composition comprising a major amount of hydrocarbons in the gasoline boiling range, or hydrocarbon/oxygenate mixtures, or oxygenates containing a minor, but effective amount, of (a) a fuel additive comprising the reaction product of (i) polyamine and (ii) at least one acyclic hydrocarbyl substituted succinic acylating agent; (b) an unhydrotreated poly-alpha-olefin having a volatility of about 50% or less as determined by a test method described therein; (c) and optionally (A) a mineral oil having a viscosity index of less than about 90 and a volatility of 50% or less as determined by a test method described therein; (B) an antioxidant, or (C) a demulsifier, or (D) an aromatic hydrocarbon solvent, or (E) a corrosion inhibitor, or any combination of any two, three, four, or all five of components (A), (B), (C), (D) and (E), it is clearly an essential feature that the poly-alpha-olefin present is an unhydrotreated poly-alpha-olefin. The demulsifier (c) includes polyoxyalkylene glycols and oxyalkylated phenolic resins, and in particular mixtures of these.

It has now surprisingly been found that gasolines incorporating combinations of particular polyalphaolefins and particular polyoxyalkylene glycol derivatives can give surprisingly enhanced engine performance in terms of an advantageous combination of minimized engine inlet system deposits and minimized valve sticking.

SUMMARY OF THE INVENTION

The present invention provides a gasoline composition comprising a major amount of a gasoline suitable for use in spark-ignition engines, a minor amount of a polyalphaolefin having a viscosity at 100° C. from about $2\times10^{-6}$ to about $2\times10^{-5}$ $m^2/s$ (2 to 20 centistokes), being a hydrogenated oligomer containing from 18 carbon atoms to 80 carbon atoms derived from at least one alphaolefinic monomer containing from 8 to 16 carbon atoms, and a minor amount of a polyoxyalkylene compound selected from glycols, mono- and diethers thereof, having a number average molecular weight ($M_n$) from about 400 to about 3000, the weight ratio of polyalphaolefin:polyoxyalkylene compound being from about 1:10 to about 10:1.

DESCRIPTION OF THE PREFERRED EMBODIMENTS

The polyalphaolefins used in the gasoline compositions of the present invention are primarily trimers, tetramers and pentamers, and synthesis of such materials is outlined in Campen et al., "Growing use of synlubes", Hydrocarbon Processing, February 1982, pages 75–82. The polyalphaolefin is preferably derived from an alphaolefinic monomer containing from 8 to 12 carbon atoms. Polyalphaolefins derived from decene-1 have been found to be very effective. The polyalphaolefin preferably has a viscosity at 100° C. of from about $6\times10^{-6}$ to about $1\times10^{-5}$ $m^2/S$ (6 to 10 centistokes). Polyalphaolefin having a viscosity at 100° C. of about $8\times10^{-6}$ $m^2/s$ (8 centistokes) has been found to be very effective.

The polyoxyalkylene compound may be represented by the formula I:

$$R^1—O(R—O)_nR^2 \quad (I)$$

wherein $R^1$ and $R^2$ independently represent hydrogen atoms or hydrocarbyl, preferably, $C_{1-40}$ hydrocarbyl, e.g., alkyl, cycloalkyl, phenyl or alkyl phenyl groups, each R independently represents an alkylene, preferably a $C_{2-8}$ alkylene, group, and n is such that $M_n$ of the polyoxyalkylene compound is from about 400 to about 3000, preferably from about 700 to about 2000, more preferably from about 1000 to about 1500.

Preferably, $R^1$ represents a $C_{8-20}$ alkyl group and $R^2$ represents a hydrogen atom. $R^1$ preferably represents a $C_{10-18}$ alkyl group, more preferably a $C_{12-15}$ alkyl group. $R^1$ may conveniently be a mixture of $C_{12-15}$ alkyl groups. In formula I the groups R are preferably 1,2-alkylene groups. Preferably each group R independently represents a $C_{2-4}$ alkylene group, e.g., an ethylene or 1,2-propylene group. Very effective results have been obtained using polyalkylene compounds wherein each group R represents a 1,2-propylene group.

The polyalphaolefin and the polyoxyalkylene compound together may advantageously be present in the gasoline composition in an amount from about 100 ppmw to about 1200 ppmw, preferably from about 100 ppmw to about 600 ppmw, more preferably from about 150 to about 500 ppmw, based on the total composition.

The weight ratio of polyalphaolefin:polyoxyalkylene compound in the gasoline composition is preferably from about 1:8 to about 8:1, more preferably from about 1:5 to about 5:1. Weight ratios from about 1:4 to about 4:1 have been found to be very effective.

The gasoline compositions of the present invention desirably also contain a minor amount of at least one hydrocarbon-soluble ashless dispersant. The compounds useful as ashless dispersants generally are characterized by a "polar" group attached to a relatively high molecular weight hydrocarbon chain. The "polar" group generally contains one or more of the elements nitrogen, oxygen and phosphorus. The solubilizing chains are generally higher in molecular weight than those employed with the metallic types, but in some instances they may be quite similar.

In general, any of the ashless dispersants which are known in the art for use in lubricants and fuels can be utilized in the gasoline compositions of the present invention.

In one embodiment of the present invention, the dispersant is selected from the group consisting of (i) at least one hydrocarbyl-substituted amine wherein the hydrocarbyl substituent is substantially aliphatic and contains at least 8 carbon atoms;

(ii) at least one acylated, nitrogen-containing compound having a hydrocarbon-based substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol, aldehyde and amino compound having at least one

—NH— group;

(iv) at least one ester of a substituted carboxylic acid;

(v) at least one polymeric dispersant;

(vi) at least one hydrocarbon-substituted phenolic dispersant; and (vii) at least one fuel soluble alkoxylated derivative of an alcohol, phenol or amine.

The hydrocarbyl-substituted amines used in the gasoline compositions of this invention are well known to those skilled in the art and they are described in a number of patents. Among these are U.S. Pat. Nos. 3,275,554, 3,438,757, 3,454,555, 3,565,804, 3,755,433 and 3,822,209. These patents disclose suitable hydrocarbyl-substituted amines for use in the present invention including their method of preparation.

A typical hydrocarbyl-substituted amine has the general formula:

$$[AXN]_x[—N([—UN—]_a[—UQ]_b)]_yR^3_cH_{1+2y+ay-c} \quad (II)$$

wherein A is hydrogen, a hydrocarbyl group of from 1 to 10 carbon atoms, or hydroxyhydrocarbyl group of from 1 to 10 carbon atoms; X is hydrogen, a hydrocarbyl group of from 1 to 10 carbon atoms, or hydroxyhydrocarbyl group of from 1 to 10 carbon atoms, and may be taken together with A and N to form a ring of from 5 to 6 annular members and up to 12 carbon atoms; U is an alkylene group of from 2 to 10 carbon atoms, any necessary hydrocarbons to accommodate the trivalent nitrogens are implied herein, $R^3$ is an aliphatic hydrocarbon of from 30 to 400 carbon atoms; Q is a piperazine structure; a is an integer of from 0 to 10; b is an integer of from 0 to 1; a+2b is an integer of from 1 to 10; c is an integer of from 1 to 5 and is an average in the range of 1 to 4, and equal to or less than the number of nitrogen atoms in the molecule; x is an integer of from 0 to 1; y is an integer of from 0 to 1; and x+y is equal to 1.

In interpreting this formula, it is to be understood that the $R^3$ and H atoms are attached to the unsatisfied nitrogen valences within the brackets of the formula. Thus, for example, the formula includes sub-generic formulae wherein the $R^3$ is attached to terminal nitrogens and isomeric subgeneric formulae wherein it is attached to non-terminal nitrogen atoms. Nitrogen atoms not attached to an $R^3$ may bear a hydrogen or an AXN substituent.

The hydrocarbyl-substituted amines useful in this invention and embraced by formula II above include monoamines such as poly(propylene)amine, N,N-dimethyl-n-poly(ethylene/propylene)amine (50:50 mole ratio of monomers), poly(isobutene)amine, N,N-di(hydroxyethyl)-N-poly(isobutene)amine, poly(isobutene/1-butene/2-butene)amine (50:25:25 mole ratio of monomers), N-(2-hydroxyethyl)-N-poly(isobutene)amine, N-(2-hydroxypropyl)-N-poly(isobutene)amine, N-poly(1-butene)-aniline, and N-poly-(isobutene)-morpholine; and polyamines such as N-poly(isobutene) ethylene diamine, N-poly(propylene) trimethylenediamine, N-poly(1-butene) diethylenetriamine, N',N'-poly(isobutene) tetraethylene pentamine, N,N-dimethyl-N'-poly(propylene), and 1,3-propylene diamine.

The hydrocarbyl-substituted amines useful in the gasoline compositions of the invention also include certain N-amino-hydrocarbyl morpholines of the general formula:

$$R^3N(A)UM \quad (III)$$

wherein $R^3$ is an aliphatic hydrocarbon group of from 30 to 400 carbons, A is hydrogen, a hydrocarbyl group of from 1 to 10 carbon atoms or hydroxyhydrocarbyl group of from 1 to 10 carbon atoms, U is an alkylene group of from 2 to 10 carbon atoms, and M is a morpholine structure. These hydrocarbyl-substituted aminohydrocarbyl morpholines as well as the polyamines described by formula II are among the typical hydrocarbyl-substituted amines used in preparing compositions of this invention.

A number of acylated, nitrogen-containing compounds having a hydrocarbon-based substituent of at least 10 aliphatic carbon atoms and made by reacting a carboxylic acid acylating agent with an amino compound are known to those skilled in the art. The acylating agent is linked to the amino compound through an imido, amido, amidine or acyloxy ammonium linkage. The hydrocarbon-based substituent of at least 10 aliphatic carbon atoms may be in either the carboxylic acid acylating agent derived portion of the molecule or in the amino compound derived portion of the molecule. Preferably, however, it is in the acylating agent portion. The acylating agent can vary from formic acid and it acylating derivatives to acylating agents having high molecular weight aliphatic substituents of up to 5,000, 10,000 or 20,000 carbon atoms. The amino compounds can vary from ammonia itself to amines having aliphatic substituents of up to 30 carbon atoms.

A typical class of acylated, nitrogen-containing compounds useful in the compositions of this invention are those made by reacting an acylating agent having an aliphatic substituent of at least 10 carbon atoms and a nitrogen compound characterized by the presence of at least one —NH— group. Typically, the acylating agent will be a mono- or polycarboxylic acid (or reactive equivalent thereof) such as a substituted succinic or propionic acid and the amino compound will be a polyamine or mixture of polyamines, most typically, a mixture of ethylene polyamines. The amine may also be a hydroxyalkyl-substituted polyamine. The aliphatic substituent in such acylating agents preferably averages at least 30 or 50 and up to 400 carbon atoms.

Illustrative hydrocarbon-based substituent groups containing at least ten aliphatic carbon atoms are n-decyl, n-dodecyl, tetrapropenyl, n-octadecyl, oleyl, chlorooctadecyl and triicontanyl. Generally, the hydrocarbon-based substituents are made from homo- or interpolymers (e.g., copolymers, terpolymers) of mono- and diolefins having 2 to 10 carbon atoms, such as ethylene, propylene, butene-1, isobutene, butadiene, isoprene, 1-hexene and, 1-octene. Typically, these olefins are 1-monoolefins. The substituent can also be derived from the halogenated (e.g., chlorinated or brominated) analogues of such homo- or interpolymers. The substituent can, however, be made from other sources, such as monomeric high molecular weight alkenes (e.g., 1-tetracontene) and chlorinated analogues and hydrochlorinated analogues thereof, aliphatic petroleum fractions, particularly paraffin waxes and cracked and chlorinated analogues and hydrochlorinated analogues thereof, white oils, synthetic alkenes such as those produced by the Ziegler-Natta process (e.g., poly(ethylene) greases) and other sources known to those skilled in the art. Any unsaturation in the substituent may be reduced or eliminated by hydrogenation according to procedures known in the art.

As used in this specification, the term "hydrocarbon-based" denotes a group having a carbon atom directly attached to the remainder of the molecule and having a predominantly hydrocarbon character within the context of this invention. Therefore, hydrocarbon-based groups can contain up to one non-hydrocarbon group for every ten carbon atoms provided this non-hydrocarbon group does not significantly alter the predominantly hydrocarbon character of the group. Those skilled in the art will be aware of such groups, which include, for example, hydroxyl, halo (especially chloro and fluoro), alkoxyl, alkyl mercapto and alkyl sulfoxy groups. Usually, however, the hydrocarbon-based substituents are purely hydrocarbyl and contain no such non-hydrocarbyl groups.

The hydrocarbon-based substituents are substantially saturated, that is, they contain no more than one carbon-to-carbon unsaturated bond for every ten carbon-to-carbon single bonds present. Usually, they contain no more than one carbon-to-carbon non-aromatic unsaturated bond for every 50 carbon-to-carbon bonds present.

The hydrocarbon-based substituents are also substantially aliphatic in nature, that is, they contain no more than one non-aliphatic moiety (cycloalkyl, cycloalkenyl or aromatic) group of six or less carbon atoms for every ten carbon atoms in the substituent. Usually, however, the substituents contain no more than one such non-aliphatic group for every fifty carbon atoms, and in many cases, they contain no such non-aliphatic groups at all; that is, the typical substituents are purely aliphatic. Typically, these purely aliphatic substituents are alkyl or alkenyl groups.

Specific examples of the substantially saturated hydrocarbon-based substituents containing an average of more than 30 carbon atoms are the following: a mixture of poly(ethylene/propylene) groups of 35 to 70 carbon atoms, a mixture of oxidatively or mechanically degraded poly (ethylene/propylene) groups of 35 to 70 carbon atoms, a mixture of poly(propylene/1-hexene) groups of 80 to 150 carbon atoms, and a mixture of polyisobutene groups having an average of 50 to 75 carbon atoms.

A preferred source of the substituents are polyisobutenes obtained by polymerization of a $C_4$ refinery stream having a butene content of 35 to 75 weight per cent and isobutene content of 30 to 60 weight per cent in the presence of a Lewis acid catalyst such as aluminum trichloride or boron trifluoride. These polyisobutenes contain predominantly (greater than 80% of total repeating units) isobutene repeating units of the configuration:

$$—C(CH_3)_2CH_2—$$

Exemplary of amino compounds useful in making these acylated compounds are the following:

(1) polyalkylene polyamines of the general formula:

$$(R^4)_2N[P—N(R^4)]_mR^4 \quad (IV)$$

wherein each $R^4$ is independently a hydrogen atom, a hydrocarbyl group or a hydroxy-substituted hydrocarbyl group containing up to 30 carbon atoms, with the proviso that at least one $R^4$ is a hydrogen atom, m is a whole number of 1 to 10 and P is a $C_{1-18}$ alkylene group;

(2) hydroxyalkyl-substituted polyamines wherein the polyamines are as described above;

(3) heterocyclic-substituted polyamines wherein the polyamines are as described above and the heterocyclic substituent is derived from, for example, piperazine, imidazoline, pyrimidine or morpholine; and (4) aromatic polyamines of the general formula:

$$Ar(NR^4_2)_z \quad (V)$$

wherein Ar is an aromatic nucleus of 6 to 20 carbon atoms, each $R^4$ is as defined above and z is 2 to 8.

Specific examples of polyalkylene polyamines of formula IV are ethylenediamine, tetra(ethylene)pentamine, tri-(trimethylene)-tetramine and1,2-propylene diamine.

Specific examples of hydroxyalkyl-substituted polyamines include N-(2-hydroxyethyl) ethylene diamine, N,N'-bis-(2-hydroxy-ethyl) ethylene diamine and N-(3-hydroxybutyl) tetramethylene diamine.

Specific examples of heterocyclic-substituted polyamines are N-2-aminoethyl piperazine, N-2- and N-3-amino propyl morpholine, N-3-(dimethyl amino) propyl piperazine, 2-heptyl-3-(2-aminopropyl) imidazoline, 1,4-bis (2-aminoethyl) piperazine, 1-(2-hydroxy ethyl) piperazine, and 2-heptadecyl-1-(2-hydroxyethyl)imidazoline.

Specific examples of aromatic polyamines are the various isomeric phenylene diamines and the various isomeric naphthalene diamines.

Many patents have described useful acylated nitrogen compounds including U.S. Pat. Nos. 3,172,892, 3,219,666, 3,272,746, 3,310,492, 3,341,542, 3,444,170, 3,455,831, 3,455,832, 3,576,743, 3,630,904, 3,632,511, 3,804,763 and 4,234,435. A typical acylated nitrogen-containing compound of this class is that made by reacting a polyisobutene-substituted succinic anhydride acylating agent wherein the polyisobutene substituent has from 50 to 400 carbon atoms with a mixture of ethylene polyamines having 3 to 7 amino nitrogen atoms per ethylene polyamine.

Another type of acylated nitrogen compound belonging to this class is that made by reacting the aforementioned alkylene amines with the aforementioned substituted succinic acids or anhydrides and aliphatic monocarboxylic acids having from 2 to 22 carbon atoms. In these types of acylated nitrogen compounds, the mole ratio of succinic acid to monocarboxylic acid is in the range from 1:0.1 to 1:1. Typical of the monocarboxylic acid are formic acid, acetic acid, dodecanoic acid, butanoic acid, oleic acid, stearic acid, the commercial mixture of stearic acid isomers known as isostearic acid and tolyl acid. Such materials are more fully described in U.S. Pat. Nos. 3,216,936 and 3,250,715.

Still another type of acylated nitrogen compound useful in the gasoline compositions of the invention is the product of the reaction of a fatty monocarboxylic acid of 12 to 30 carbon atoms and the aforementioned alkylene amines, typically, ethylene, propylene or trimethylene polyamines containing 2 to 8 amino groups and mixtures thereof. The fatty monocarboxylic acids are generally mixtures of straight and branched chain fatty carboxylic acids containing 12 to 30 carbon atoms. A widely used type of acylated nitrogen compound is made by reacting the aforementioned alkylene polyamines with a mixture of fatty acids having from 5 to 30 mole per cent straight chain acid and 70 to 95 mole per cent branched chain fatty acids. Among the commercially available mixtures are those known widely in the trade as isostearic acid. These mixtures are produced as a by-product from the dimerization of unsaturated fatty acids as described in U.S. Pat. Nos. 2,812,342 and 3,260,671.

The branched chain fatty acids can also include those in which the branch is not alkyl in nature, such as found in phenyl and cyclohexyl stearic acid and the chloro-stearic acids. Branched chain fatty carboxylic acid/alkylene polyamine products have been described, for example in U.S. Pat. Nos. 3,110,673, 3,251,853, 3,326,801, 3,337,459, 3,405,064, 3,429,674, 3,468,639 and 3,857,791.

The phenol/aldehyde/amino compound condensates useful as dispersants in the gasoline compositions of the invention include those generically referred to as Mannich condensates. Generally, they are made by reacting simultaneously or sequentially at least one active hydrogen compound such as a hydrocarbon-substituted phenol (e.g., an alkyl phenol wherein the alkyl group has at least an average of 12 to 400, preferably 30 to 400, carbon atoms), having at least one hydrogen atom bonded to an aromatic carbon, with at least one aldehyde or aldehyde-producing material (typically formaldehyde precursor) and at least one amino or polyamino compound having at least one NH group. The amino compounds include primary or secondary monoamines having hydrocarbon substituents of 1 to 30 carbon atoms or hydroxyl-substituted hydrocarbon substituents of 1 to 30 carbon atoms. Another type of typical amino compound are the polyamines described during the discussion of the acylated nitrogen-containing compounds.

Exemplary monoamines include methyl ethyl amine, methyl octadecyl amines, aniline, diethyl amine, diethanol amine and dipropyl amine. The following patents contain extensive descriptions of Mannich condensates: U.S. Pat. Nos. 2,459,112, 3,413,347, 3,558,743, 2,962,442, 3,442,808, 3,586,629, 2,984,550, 3,448,047, 3,591,598, 3,036,003, 3,454,497, 3,600,372, 3,166,516, 3,459,661, 3,634,515, 3,236,770, 3,461,172, 3,649,229, 3,355,270, 3,493,520, 3,697,574, 3,368,972 and 3,539,633.

Condensates made from sulfur-containing reactants can also be used in the gasoline compositions of the present invention. Such sulfur-containing condensates are described in U.S. Pat. Nos. 3,368,972, 3,649,229, 3,600,372, 3,649,659 and 3,741,896. These patents also disclose sulfur-containing Mannich condensates. Generally the condensates used in making compositions of this invention are made from a phenol bearing an alkyl substituent of 6 to 400 carbon atoms, more typically, 30 to 250 carbon atoms. These typical condensates are made from formaldehyde or $C_{2-7}$ aliphatic aldehyde and an amino compound such as those used in making the acylated nitrogen-containing compounds described above.

These preferred condensates are prepared by reacting one molar portion of phenolic compound with 1 to 2 molar portions of aldehyde and 1 to 5 equivalent portions of amino compound (an equivalent of amino compound is its molecular weight divided by the number of ═NH groups present). The conditions under which such condensation reactions are carried out are well known to those skilled in the art.

A particularly preferred class of nitrogen-containing condensation products for use in the gasoline compositions of the present invention are those made by (1) reacting at least one hydroxy aromatic compound containing an aliphatic-based or cycloaliphatic-based substituent which has at least 30 carbon atoms and up to 400 carbon atoms with a lower aliphatic $C_{1-7}$ aldehyde or reversible polymer thereof in the presence of an alkaline reagent, such as an alkali metal hydroxide, at a temperature up to 150° C.; (2) substantially neutralizing the intermediate reaction mixture thus formed; and (3) reacting the neutralized intermediate with at least one compound which contains an amino group having at least one —NH— group.

More preferably, these condensates are made from (a) phenols bearing a hydrocarbon-based substituent having 30 to 250 carbon atoms, said substituent being derived from a polymer of propylene, 1-butene, 2-butene, or isobutene and (b) formaldehyde, or reversible polymer thereof, (e.g., trioxane, paraformaldehyde) or functional equivalent thereof, (e.g., methylol) and (c) an alkylene polyamine such as ethylene polyamines having from 2 to 10 nitrogen atoms.

The esters useful as dispersants in the gasoline compositions of the invention are derivatives of substituted carboxylic acids in which the substituent is a substantially aliphatic, substantially saturated hydrocarbon-based group containing at least 30, preferably at least 50, up to 750 aliphatic carbon atoms. As used herein, the term "hydrocarbon-based group" denotes a group having a carbon atom directly attached to the remainder of the molecule and having predominantly hydrocarbon character within the context of this invention. Such groups include the following:

(1) Hydrocarbon groups; that is, aliphatic groups, aromatic- and alicyclic-substituted aliphatic groups, and the like, of the type known to those skilled in the art.

(2) Substituted hydrocarbon groups; that is, groups containing non-hydrocarbon substituents which, in the context of this invention, do not alter the predominantly hydrocarbon character of the group. Those skilled in the art will be aware of suitable substituents; examples are halo, nitro, hydroxy, alkoxy, carbalkoxy and alkylthio.

(3) Hetero groups; that is, groups which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based group.

The substituted carboxylic acids are normally prepared by the alkylation of an unsaturated acid, or a derivative thereof such as an anhydride, with a source of the desired hydrocarbon-based group. Suitable unsaturated acids and derivatives thereof include acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid and 2-pentene-1,3,5-tricarboxylic acid. Particularly preferred are the unsaturated dicarboxylic acids and their derivatives, especially maleic acid, fumaric acid and maleic anhydride.

Suitable alkylating agents include homopolymers and interpolymers of polymerizable olefin monomers containing from 2 to 10 and usually from 2 to 6 carbon atoms, and polar substituent-containing derivatives thereof. Such polymers are substantially saturated (i.e., they contain no more than about 5% olefinic linkages) and substantially aliphatic (i.e., they contain at least 80% and preferably at least 95% by weight of units derived from aliphatic monoolefins). Illustrative monomers which may be used to produce such polymers are ethylene, propylene, 1-butene, 2-butene, isobutene, 1-octene and 1-decene. Any unsaturated units may be derived from conjugated dienes such as 1,3-butadiene and isoprene; non-conjugated dienes such as 1,4-hexadiene, 1,4-cyclohexadiene, 5-ethylidene-2-norbornene and 1,6-octadiene; and trienes such as 1-isopropylidene-3a,4,7,7a-tetrahydroindene, 1-isopropylidene-dicyclopentadiene and 2-(2-methylene-4-methyl-3-pentenyl)[2.2.1]-bicyclo-5-heptene.

A first preferred class of polymers comprises those of terminal olefins such as propylene, 1-butene, isobutene and 1-hexene. Especially preferred within this class are polybutenes comprising predominantly isobutene units. A second preferred class comprises terpolymers of ethylene, a $C_{3-8}$ alpha-monoolefin and a polyene selected from the group consisting of non-conjugated dienes (which are especially preferred) and trienes. Illustrative of these terpolymers is "Ortholeum 2052" manufactured by E.I. du Pont de Nemours & Company, which is a terpolymer containing about 48 mole per cent ethylene groups, 48 mole per cent propylene groups and 4 mole per cent 1,4-hexadiene groups and having an inherent viscosity of 1.35 (8.2 grams of polymer in 10 ml of carbon tetrachloride at 30° C.).

Methods for the preparation of the substituted carboxylic acids and derivatives thereof are well known in the art and need not be described in detail. Reference is made, for example, to U.S. Pat. Nos. 3,272,746, 3,522,179 and 4,234,435. The mole ratio of the polymer to the unsaturated acid or derivative thereof may be equal to, greater than or less than 1, depending on the type of product desired.

The esters are those of the above-described substituted carboxylic acids with hydroxy compounds which may be aliphatic compounds such as monohydric and polyhydric alcohols or aromatic compounds such as phenols and naphthols. Examples of aromatic hydroxy compounds include phenol, beta-naphthol, alpha-naphthol, cresol, resorcinol, catechol, p,p'-dihydroxybiphenyl, 2-chlorophenol, 2,4-dibutylphenol, propene tetramer-substituted phenol, didodecylphenol, 4,4'-methylene-bis-phenol, alpha-decyl-beta-naphthol, polyisobutene (molecular weight of 1000)-substituted phenol, the condensation product of heptylphenol with formaldehyde, the condensation product of octylphenol with acetone, di(hydroxyphenyl)-oxide, di(hydroxyphenyl)sulfide, di(hydroxyphenyl)disulfide, and 4-cyclo-hexylphenol. Phenol and alkylated phenols having up to three alkyl substituents are preferred. Each of the alkyl substituents may contain 100 or more carbon atoms.

The aliphatic alcohols from which the esters may be derived preferably contain up to 40 aliphatic carbon atoms. They may be monohydric alcohols such as methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, monooleate of ethylene glycol, monostearate of diethylene glycol, secpentyl alcohol, tertbutyl alcohol, 5-bromo-dodecanol, nitro-octadecanol and dioleate of glycerol. The polyhydric alcohols preferably contain from 2 to 10 hydroxy radicals. They are illustrated by, for example, ethylene glycol, diethylene glycol, triethylene glycol, tetraethylene glycol, dipropylene glycol, tripropylene glycol, dibutylene glycol, tri-butylene glycol, and other alkylene glycols in which the alkylene radical contains from 2 to 8 carbon atoms. Other useful polyhydric alcohols include glycerol, monooleate of glycerol, monostearate of glycerol, monomethyl ether of glycerol, pentaerythritol, 9,10-dihydroxy stearic acid, methyl ester of 9,10-dihydroxy stearic acid, 1,2-butanediol, 2,3-hexanediol, 2,4-hexanediol, penacol, erythritol, arabitol, sorbitol, mannitol, 1,2-cyclohexanediol, and xylene glycol. Carbohydrates such as sugars, starches and cellulose may also yield esters useful in this invention. The carbohydrates may be exemplified by glucose, fructose, sucrose, rhamnose, mannose, glyceraldehyde and galactose.

An especially preferred class of polyhydric alcohols are those having at least three hydroxy radicals, some of which have been esterified with a monocarboxylic acid having from 8 to 30 carbon atoms, such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, di-dodecanoate of erythritol.

The esters may also be derived from unsaturated alcohols such as allyl alcohol, cinnamyl alcohol, propargyl alcohol, 1-cyclohexene-3-ol and oleyl alcohol. Still another class of the alcohols capable of yielding the esters useful in this invention comprise the ether-alcohols and amino-alcohols including, for example, the oxyalkylene-, oxyarylene-, amino-alkylene- and amino-arylene-substituted alcohols having one or more oxyalkylene, oxyarylene, amino-alkylene or amino-arylene radicals. They are exemplified by Cellosolve, carbitol, phenoxyethanol, heptylphenyl-(oxypropylene)$_6$-H, octyl-(oxyethylene)$_{30}$-H, phenyl-(oxyoctylene)$_2$-H, mono(heptylphenyl-oxypropylene)-substituted glycerol, poly(styrene oxide), amino-ethanol, 3-amino ethyl-pentanol, di(hydroxyethyl) amine, p-amino-phenol, tri(hydroxypropyl)amine, N-hydroxyethyl ethylene diamine and N,N,N',N'-tetrahydroxy-trimethylene diamine. For the most part, the ether-alcohols having up to about 150 oxyalkylene radicals in which the alkylene radical contains from 1 to 8 carbon atoms are preferred.

The esters may be diesters of succinic acids or acidic esters, i.e., partially esterified polyhydric alcohols or phenols, i.e., esters having free alcoholic or phenolic hydroxyl radicals. Mixtures of the above-illustrated esters likewise are contemplated within the scope of the invention.

The succinic acid esters may be prepared by one of several methods. The method which is preferred because of convenience and superior properties of the esters it produces, involves the reaction of a suitable alcohol or phenol with a substantially hydrocarbon-substituted succinic anhydride. The esterification is usually carried out at a temperature above about 100° C., preferably between 150° C. and 300° C.

The water formed as a by-product is removed by distillation as the esterification proceeds. A solvent may be used in the esterification to facilitate mixing and temperature control. It also facilitates the removal of water from the reaction mixture. The useful solvents include xylene, toluene, diphenyl ether, chlorobenzene and mineral oil.

A modification of the above process involves the replacement of the substituted succinic anhydride with the corresponding succinic acid. However, succinic acids readily undergo dehydration at temperatures above about 100° C. and are thus converted to their anhydrides which are then esterified by the reaction with the alcohol reactant. In this regard, succinic acids appear to be the substantial equivalent of their anhydrides in the process.

The relative proportions of the succinic reactant and the hydroxy reactant which are to be used depend to a large measure upon the type of the product desired and the number of hydroxyl groups present in the molecule of the hydroxy reactant. For instance, the formation of a half ester of a succinic acid, i.e., one in which only one of the two acid radicals is esterified, involves the use of one mole of a monohydric alcohol for each mole of the substituted succinic acid reactant, whereas the formation of a diester of a succinic acid involves the use of two moles of the alcohol for each mole of the acid. On the other hand, one mole of a hexahydric alcohol may combine with as many as six moles of a succinic acid to form an ester in which each of the six hydroxyl radicals of the alcohol is esterified with one of the two acid radicals of the succinic acid. Thus, the maximum proportion of the succinic acid to be used with a polyhydric alcohol is determined by the number of hydroxyl groups present in the molecule of the hydroxy reactant. For the purposes of this invention, it has been found that esters obtained by the reaction of equimolar amounts of the succinic acid reactant and hydroxy reactant have superior properties and are therefore preferred.

In some instances, it is advantageous to carry out the esterification in the presence of a catalyst such as sulfuric acid, pyridine hydrochloride, hydrochloric acid, benzene-sulfonic acid, p-toluenesulfonic acid, phosphoric acid, or any other known esterification catalyst. The amount of the catalyst in the reaction may be as little as 0.01% (by weight of the reaction mixture), more often from 0.1% to 5%.

The succinic acid esters may alternatively be obtained by the reaction of a substituted succinic acid or anhydride with an epoxide or a mixture of an epoxide and water. Such reaction is similar to one involving the acid or anhydride with a glycol. For instance, the product may be prepared by the reaction of a substituted succinic acid with one mole of ethylene oxide. Similarly, the product may be obtained by the reaction of a substituted succinic acid with two moles of ethylene oxide. Other epoxides which are commonly available for use in such reaction include, for example, propylene oxide, styrene oxide, 1,2-butylene oxide, 2,3-butylene oxide, epichlorohydrin, cyclohexene oxide, 1,2-octylene oxide, epoxidized soya bean oil, methyl ester of 9,10-epoxy-stearic acid and butadiene mono-epoxide. For the most part, the epoxides are the alkylene oxides in which the alkylene radical has from 2 to 8 carbon atoms; or the epoxidized fatty acid esters in which the fatty acid radical has up to 30 carbon atoms and the ester radical is derived from a lower alcohol having up to 8 carbon atoms.

In lieu of the succinic acid or anhydride, a lactone acid or a substituted succinic acid halide may be used in the processes illustrated above. Such acid halides may be acid dibromides, acid dichlorides, acid monochlorides, and acid monobromides. The substituted succinic anhydrides and acids can be prepared by, for example, the reaction of maleic anhydride with a high molecular weight olefin or a halogenated hydrocarbon such as is obtained by the chlorination of an olefin polymer described previously. The reaction involves merely heating the reactants at a temperature preferably from 100° C. to 250° C. The product from such a reaction is an alkenyl succinic anhydride. The alkenyl group may be hydrogenated to an alkyl group. The anhydride may be hydrolyzed by treatment with water or steam to the corresponding acid. Another method useful for preparing the succinic acids or anhydrides involves the reaction of itaconic acid or anhydride with an olefin or a chlorinated hydrocarbon at a temperature usually within the range from 100° C. to 250° C. The succinic acid halides can be prepared by the reaction of the acids or their anhydrides with a halogenation agent such as phosphorous tribromide, phosphorus pentachloride, or thionyl chloride. These and other methods of preparing the succinic compounds are well known in the art and need not be illustrated in further detail here.

Still further methods of preparing esters useful in the gasoline compositions of the present invention are available. For instance, the esters may be obtained by the reaction of maleic acid or anhydride with an alcohol such as is illustrated above to form a mono- or di-ester of maleic acid and then the reaction of this ester with an olefin or a chlorinated hydrocarbon such as is illustrated above. They may also be obtained by first esterifying itaconic anhydride or acid and subsequently reacting the ester intermediate with an olefin or a chlorinated hydrocarbon under conditions similar to those described hereinabove.

A large number of different types of polymeric dispersants have been suggested as useful in lubricating oil formulations, and such polymeric dispersants are useful in the gasoline compositions of the present invention. Often, such additives have been described as being useful in lubricating formulations as viscosity index improvers with dispersing characteristics. The polymeric dispersants generally are polymers or copolymers having a long carbon chain and containing "polar" groups to impart the dispersancy characteristics. Examples of polar groups include amino, amido, imino, imido, hydroxyl and ether groups. For example, the polymeric dispersants may be copolymers of methacrylates or acrylates containing additional polar groups, ethylene/propylene copolymers containing polar groups or vinyl acetate/fumaric acid ester copolymers.

Many such polymeric dispersants have been described in the prior art, for example in U.S. Pat. Nos. 4,402,844, 3,356,763 and 3,891,721.

A number of the polymeric dispersants may be prepared by grafting polar monomers on to polyolefinic backbones. For example, U.S. Pat. Nos. 3,687,849 and 3,687,905 describe the use of maleic anhydride as a graft monomer to a polyolefinic backbone. Maleic acid or anhydride is particularly desirable as a graft monomer because this monomer is relatively inexpensive, provides an economical route to the incorporation of dispersant nitrogen compounds into polymers by further reaction of the carboxyl groups of the maleic acid or anhydride with, for example, nitrogen compounds or hydroxy compounds. U.S. Pat. No. 4,160,739 describes graft copolymers obtained by the grafting of a monomer system comprising maleic acid or anhydride and at least one other different monomer which is addition copolymerizable therewith, the grafted monomer system then being post-reacted with a polyamine. The monomers which are copolymerizable with maleic acid or anhydride are any alpha, beta-monoethylenically unsaturated monomers which are sufficiently soluble in the reaction medium and reactive towards maleic acid or anhydride so that substantially larger amounts of maleic acid or anhydride can be incorporated into the grafted polymeric product. Accordingly, suitable monomers include the esters, amides and nitriles of acrylic and methacrylic acid, and monomers containing no free acid groups. The incorporation of heterocyclic monomers into graft polymers is described by a process which comprises a first step of graft polymerizing an alkyl ester of acrylic acid or methacrylic acid, alone or in combination with styrene, onto a backbone copolymer which is a hydrogenated block copolymer of styrene and a conjugated diene having 4 to 6 carbon atoms to form a first graft polymer. In the second step, a polymerizable heterocyclic monomer, alone or in combination with a hydrophobizing vinyl ester is co-polymerized onto the first graft copolymer to form a second graft copolymer.

Other patents describing graft polymers useful as dispersants in the gasoline compositions of this invention include U.S. Pat. Nos. 3,243,481, 3,475,514, 3,723,575, 4,026,167, 4,085,055, 4,181,618 and 4,476,283.

Another class of polymeric dispersant useful in the gasoline compositions of the invention are the so-called "star" polymers and copolymers. Such polymers are described in, for example U.S. Pat. Nos. 4,346,193, 4,141,847, 4,358,565, 4,409,120 and 4,077,893.

The hydrocarbon-substituted phenolic dispersants useful in the gasoline compositions of the present invention include the hydrocarbon-substituted phenolic compounds wherein the hydrocarbon substituents have a molecular weight which is sufficient to render the phenolic compound fuel soluble. Generally, the hydrocarbon substituent will be a substantially saturated, hydrocarbon-based group of at least 30 carbon atoms. The phenolic compounds may be represented generally by the following formula:

$$(R^5)_e—Ar^1—(OH)_f \quad \text{(VI)}$$

wherein $R^5$ is a substantially saturated hydrocarbon-based substituent having an average of from 30 to 400 aliphatic carbon atoms, and e and f are each 1, 2 or 3. $Ar^1$ is an aromatic moiety such as a benzene nucleus, naphthalene nucleus or linked benzene nuclei. Optionally, the above phenates as represented by formula VI may contain other substituents such as lower alkyl, lower alkoxy, nitro, amino and halo groups. Preferred examples of optional substituents are the nitro and amino groups.

The substantially saturated hydrocarbon-based group $R^5$ in formula VI may contain up to 750 aliphatic carbon atoms although it usually has a maximum of an average of 400 carbon atoms. In some instances $R^5$ has a minimum of 50 carbon atoms. As noted, the phenolic compounds may contain more than one $R^5$ group for each aromatic nucleus in the aromatic moiety $Ar^1$.

Generally, the hydrocarbon-based groups $R^5$ are derived from homo- or interpolymers (e.g., copolymers, terpolymers) of mono- and diolefins having 2 to 10 carbon atoms, such as ethylene, propylene, butene-1, isobutene, butadiene, isoprene, 1-hexene and 1-octene. Typically, these olefins are 1-monoolefins. The $R^5$ groups can also be derived from the halogenated (e.g., chlorinated or brominated) analogues of such homo- or interpolymers. The $R^5$ groups can, however, be made from other sources, such as monomeric high molecular weight alkenes (e.g., 1-tetracontene) and chlorinated analogues and hydrochlorinated analogues thereof, aliphatic petroleum fractions, particularly paraffin waxes and cracked and chlorinated analogues and hydrochlorinated analogues thereof, white oils, synthetic alkenes such as those produced by the Ziegler-Natta process (e.g., poly(ethylene) greases) and other sources known to those skilled in the art. Any unsaturation in the $R^5$ groups may be reduced or eliminated by hydrogenation according to procedures known in the art before the nitration step described hereafter.

Specific examples of the substantially saturated hydrocarbon-based $R^5$ groups are the following: a tetracontanyl group, a henpentacontanyl group, a mixture of poly (ethylene/propylene) groups of 35 to 70 carbon atoms, a mixture of oxidatively or mechanically degraded poly (ethylene/propylene) groups of 35 to 70 carbon atoms, a mixture of poly(propylene/1-hexene) groups of 80 to 150 carbon atoms, a mixture of polyisobutene groups having 20 to 32 carbon atoms, and a mixture of polyisobutene groups having an average of 50 to 75 carbon atoms.

A preferred source of the group $R^5$ are polyisobutenes obtained by polymerization of a $C_4$ refinery stream having a butene content of 35 to 75 weight per cent and isobutene content of 30 to 60 weight per cent in the presence of a Lewis acid catalyst such as aluminum trichloride or boron trifluoride. These polyisobutenes contain predominantly (greater than 80% of total repeat units) isobutene repeating units of the configuration.

$$—C(CH_3)_2CH_2—$$

The attachment of the hydrocarbon-based group $R^5$ to the aromatic moiety $Ar^1$ can be accomplished by a number of techniques well known to those skilled in the art.

In one preferred embodiment, the phenolic dispersants useful in the gasoline compositions of the present invention are hydrocarbon-substituted nitro phenols as represented by formula VI wherein the optional substituent is one or more nitro groups. The nitro phenols can be conveniently prepared by nitrating appropriate phenols, and typically, the nitro phenols are formed by nitration of alkyl phenols having an alkyl group of at least 30 and preferably at least 50 carbon atoms. The preparation of a number of hydrocarbon-substituted nitro phenols useful in the gasoline compositions of the present invention is described in U.S. Pat. No. 4,347,148.

In another preferred embodiment, the hydrocarbon-substituted phenol dispersants useful in the present invention are hydrocarbon-substituted amino phenols such as represented by formula VI wherein the optional substituent is one or more amino groups. These amino phenols can conveniently be prepared by nitrating an appropriate hydroxy aromatic compound as described above and thereafter reducing the nitro groups to amino groups. Typically, the useful amino phenols are formed by nitration and reduction of alkyl phenols having an alkyl or alkenyl group of at least 30 and preferably at least 50 carbon atoms. The preparation of a large number of hydrocarbon-substituted amino phenols useful as dispersants in the present invention is described in U.S. Pat. No. 4,320,021.

Also useful as dispersants in the gasoline compositions of the present invention are fuel-soluble alkoxylated derivatives of alcohols, phenols and amines. A wide variety of such derivatives can be utilized as long as the derivatives are fuel-soluble. More preferably, the derivatives in addition to being fuel-soluble should be water-insoluble. Accordingly, in a preferred embodiment, the fuel-soluble alkoxylated derivatives useful as the dispersants are characterized as having an HLB of from 1 to 13.

As is well known to those skilled in the art, the fuel-solubility and water-insolubility characteristics of the alkoxylated derivatives can be controlled by selection of the alcohol, phenol or amine, selection of the particular alkoxy reactant, and by selection of the amount of alkoxy reactant which is reacted with the alcohol, phenol or amine. Accordingly, the alcohols which are utilized to prepare the alkoxylated derivatives are hydrocarbon-based alcohols while the amines are hydrocarbyl-substituted amines as described above. The phenols may be phenols or hydrocarbon-substituted phenols and the hydrocarbon substituent may contain as few as 1 carbon atom.

The alkoxylated derivatives are obtained by reacting the alcohol, phenol or amine with an epoxide or a mixture of an epoxide and water. For example, the derivative may be prepared by the reaction of the alcohol, phenol or amine with an equal molar amount or an excess of ethylene oxide. Other epoxides which can be reacted with the alcohol, phenol or amine include, for example, propylene oxide, styrene oxide, 1,2-butylene oxide, 2,3-butylene oxide, epichlorohydrin, cyclohexene oxide and 1,2-octylene oxide. Preferably, the epoxides are the alkylene oxides in which the alkylene group has from 2 to 8 carbon atoms. As mentioned above, it is desirable and preferred that the amount of alkylene oxide reacted with the alcohol, phenol or amine be insufficient to render the derivative water-soluble.

The following are examples of commercially available alkylene oxide derivatives which may be utilized as dispersants in the gasoline compositions of the present invention: Ethomeen S/12, tertiary amines ethylene oxide condensation products of the primary fatty amines (HLB, 4.15; Armak Industries); and Plurafac A-24, an oxyethylated straight-chain alcohol available from BASF Wyandotte Industries (HLB 5.0). Other suitable fuel-soluble alkoxylated derivatives of alcohols, phenols and amines will be readily apparent to those skilled in the art.

In a particularly preferred embodiment further to the polyalphaolefin and the polyoxyalkylene compound, the gasoline composition of the invention may additionally contain as ashless dispersant a minor amount of a polyolefin-substituted succinimide derivative wherein the polyolefin has a $M_n$ from about 800 to about 5000, preferably from about 1000 to about 5000, more preferably at least about 1750, 1800 or 1850 and at most about 4000, 3500, 3000 or 2500. The amine from which the succinimide is formed is preferably a $C_{1-30}$ amine, especially a $C_{4-12}$ amine containing 3 to 7 nitrogen atoms, e.g., diethylene triamine, triethylene tetramine, tetramethylene pentamine, pentaethylene hexamine, hexaethylene heptamine, tripropylene tetramine and mixtures of any 2 or more thereof.

Preferably, the hydrocarbon-soluble ashless dispersant is present in an amount from about 30 ppmw to about 500 ppmw, more preferably from about 100 ppmw to about 300 ppmw, based on the total composition.

The gasoline composition may additionally include (e.g., as an alternative to inclusion of succinimide derivative) an oil soluble polyamine as described in EP-A-290 088 or an N-substituted carbamate as described in EP-A-414 963, in each case, in similar quantities to those described therein.

The gasoline composition may further include, as flame-speed improver, an alkali metal or alkaline earth metal salt of a succinic acid derivative as described in EP-A-290 088 or an N-substituted carbamate as described in EP-A-414 963, in each case in similar quantities to those described therein.

Apart from components already described above, the gasoline composition may also contain other additives. Thus, it can contain a lead compound as anti-knock additive, and accordingly the gasoline composition according to the invention includes both leaded and unleaded gasoline. The gasoline composition can also contain antioxidants such as phenolics, e.g., 2,6-di-tert-butyl-phenol, or phenylenediamines, e.g., N,N'-di-sec-butyl-p-phenylenediamine, or antiknock additives other than lead compounds, or polyether amino additives, e.g., as described in U.S. Pat. No. 4,477,261 and EP-A-151 621.

The gasoline composition according to the invention comprises a major amount of a gasoline (base fuel) suitable for use in spark-ignition engines. This includes hydrocarbon base fuels boiling essentially in the gasoline boiling range of from about 30° C. to about 230° C. These base fuels may comprise mixtures of saturated, olefinic and aromatic hydrocarbons. They can be derived from straight-run gasoline, synthetically produced aromatic hydrocarbon mixtures, thermally or catalytically cracked hydrocarbon feedstocks, hydrocracked petroleum fractions or catalytically reformed hydrocarbons. The octane number of the base fuel is not critical and will generally be above 85. In the gasoline, hydrocarbons can be replaced up to substantial amounts by alcohols, ethers, ketones, or esters. Naturally, the base fuels are desirably substantially free of water, since water may impede a smooth combustion.

The polyalphaolefin and polyoxyalkylene compound may conveniently be added as a blend with other chosen additives. A convenient method for preparing the gasoline composition is therefore to prepare a concentrate of the polyalphaolefin and polyoxyalkylene compound together with the other additives, and then to add this concentrate to the gasoline in the amount required to produce the required final concentrations of additives.

The invention accordingly further provides a concentrate suitable for addition to gasoline which comprises a gasoline-compatible diluent, a polyalphaolefin as defined above, a polyoxyalkylene compound as defined above, the weight ratio of polyalphaolefin:polyoxyalkylene compound being from about 1:10 to about 10:1, and optionally also at least one hydrocarbon-soluble ashless dispersant.

Advantageously, the polyalphaolefin and the polyoxyalkylene compound together are present in an amount from about 20% w to about 80% w and the ashless dispersant, if present, is present in an amount from about 5% w to about 30% w, all percentages being calculated on the diluent.

Suitable gasoline-compatible diluents include hydrocarbons, e.g., heptane, alcohols or ethers, such as methanol, ethanol, propanol, 2-butoxyethanol or methyl tert-butyl ether. Preferably, the diluent is an aromatic hydrocarbon solvent such as toluene, xylene, mixtures thereof or mixtures of toluene or xylene with an alcohol. The solvent is preferably toluene. Optionally, the concentrate may contain a dehazer, particularly a polyether-type ethoxylated alkylphenol-formaldehyde resin. The dehazer, if employed, can suitably be present in the concentrate in an amount from about 0.01% w to about 2% w, calculated on the diluent.

In a further aspect, the invention provides a method for operating a spark-ignition internal combustion engine which comprises introducing into the combustion chambers of said engine a gasoline composition as defined above in accordance with the invention.

The ranges and limitations provided in the instant specification and claims are those which are believed to particularly point out and distinctively claim the instant invention. It is, however, understood that other ranges and limitations that perform substantially the same function in substantially the same way to obtain the same or substantially the same result are intended to be within the scope of the instant invention as defined by the instant specification and claims.

The invention will be further understood from the following examples which are provided for illustrative purposes only and are not to be construed as limiting the invention.

EXAMPLES

In the examples, various additives are designated as follows:

(a) "PGHE" is a polyoxypropylene glycol hemiether (monoether) prepared using a mixture of $C_{12-15}$ alcohols as initiator, and having a $M_n$ from about 1200 to about 1500 and a kinematic viscosity from about 72 $mm^2/s$ to about 82 $mm^2/s$ at 40° C. according to ASTM D 445, available under the trade designation "SAP 949" from member companies of the Royal Dutch/Shell group;

(b) "PAO" is a polyalphaolefin, being a hydrogenated oligomer of decene-1 having a viscosity at 100° C. of about $8\times10^{-6}$ $m^2/s$ (8 centistokes).

(c) "PMP" is a 40% w/w solution in xylene of polyisobutylene succinimide prepared by reaction of a polyisobutylene having a number average molecular weight ($M_n$) of 2470 (determined by quantitative reaction with ozone) with maleic anhydride, followed by reaction of the resulting polyisobutylene succinic anhydride product with a mixture of tetraethylene pentamine, pentaethylene hexamine and hexamethylene heptamine (molar ratio 1:2:1) in molar ratio anhydride:amine of 2:1.

In the examples which follow, amounts of PMP are quoted as amounts of solution, and where amounts of xylene are quoted, these do not include the xylene associated in the 40% w/w solutions of PMP.

In the examples, additive concentrates were prepared by taking samples of PMP and adding, with stirring at 20° C., amounts of PAO (and additional xylene), followed by addition of amounts of PGHE. Samples of these additive concentrates were then incorporated into gasoline compositions, with stirring, in amounts to give desired concentrations of components. This mirrors actual industry practice, and it is important both for the additive concentrates to be fully stable, and for gasolines containing the additives to give good performance in terms of engine cleanliness and avoidance of valve sticking.

Examples 1 to 8

Additive concentrates in accordance with the invention and comparative examples were prepared as described above and stored for 6 weeks at 20° C. and −20° C., after which stability was assessed visually. Results are given in Table I.

TABLE I

| | Quantities (g) | | | | | |
|---|---|---|---|---|---|---|
| | | Additive Oil | | Additional | Ratio PHGE: | Storage (6 weeks) at 20° C. |
| Example | PMP | PHGE | PAO | Xylene | PAO | and −20° C. |
| Comp. A | 20 | 25 | — | 105 | 1:0 | deposits |
| 1 | 20 | 12.5 | 12.5 | 40 | 1:1 | clear |
| Comp. B | 30 | 30 | — | 100 | 1:0 | slightly hazy* |
| 2 | 30 | 15 | 15 | 40 | 1:1 | clear |
| Comp. C | 30 | 40 | — | 90 | 1:0 | phase separation* |
| 3 | 30 | 20 | 20 | 60 | 1:1 | clear |
| 4 | 30 | 25 | 15 | 80 | 1.67:1 | clear |
| Comp. D | 40 | 40 | — | 100 | | phase separation* |
| 5 | 40 | 20 | 20 | 70 | 1:1 | clear |
| 6 | 40 | 10 | 30 | 40 | 1:3 | clear |
| 7 | 20 | 17.5 | 17.5 | 50 | 1:1 | clear |
| 8 | 25 | 20 | 20 | 60 | 1:1 | clear |

*20° C. storage only

As can readily be observed, the additive concentrates of the invention, containing both PHGE and PAO, had good storage stability, while the comparative examples, containing PHGE alone, were insufficiently stable.

Examples 9 and 10

A standard VW Polo motor car, equipped with a single carburetor, 4 cylinder, 1.043 liter capacity engine, was used for evaluation of inlet valve cleanliness in a standard road test sequence (Volkswagen Polo Road Test).

Before test inlet parts and combustion chambers were cleaned and new, pre-weighed inlet valves and new spark plugs were fitted to the engine, a new oil filter was fitted and the engine filled with new engine oil. A small wind board was fixed to the roof of the test vehicle to increase wind resistance, and hence engine load. The fuel tank was drained and filled with test gasoline composition prior to operation over a 5000 km test distance. 37 minute test cycles were employed, wherein the vehicle was driven for 30 minutes at 4500 r.p.m. in 4th gear (105 kph) and then allowed to idle for 7 minutes. 12 cycles were covered each day for 8 consecutive days to cover the test distance of 5000 km. At the end of the test, the inlet valves were removed and weighed in order to assess average weight of inlet valve deposits.

Gasoline compositions in accordance with the invention were subject to comparative testing in tests carried out using unleaded gasoline (95 ULG) containing no additives (base gasoline) or containing PMP and either or both of PHGE and PAO. Results are given in Table II following.

TABLE II

| Test No. | Concentrations (ppmw) PMP | Additive Oil PHGE | Additive Oil PAO | Average inlet valve deposit weight (mg) |
|---|---|---|---|---|
| Comp. E | — | — | — | 387 |
| Example 9 | 250 | 250 | 250 | 31 |
| Comp. F | 250 | 500 | — | 54 |
| Comp. G | 250 | — | 500 | 82 |
| Example 10 | 300 | 200 | 200 | 20 |
| Comp. H | 300 | 300 | — | 44 |

The data in Table II show that in the instances where additive oil comprises a combination of PHGE and PAO, weights of deposit on the inlet valves are significantly and surprisingly lower compared with the case where the corresponding amount of additive oil consists solely of one or other PHGE and PAO.

Examples 11 to 23

A standard Opel Ascona 1.6 motor car, equipped with a standard 4-cylinder 1.6 liter Type 16SH engine, was used for evaluation of valve sticking by a standard test method.

The test method involved driving the vehicle using a test gasoline composition on normal city roads over a total distance of 130 km over a low-duty cycle (maximum speed 50 kph). The vehicle was then stored overnight at −20° C., and the maximum compression pressure in each cylinder was measured and the average of the four values was calculated. The higher the pressure value, the better the result.

In a similar manner to Table II, the compositions of the test gasoline compositions, and the results obtained, are given in Table III following, wherein "additive oil" consisted of PHGE and/or PAO:

TABLE III

| Test No. (bar) ($\times 10^5$ Pa) | Concentrations (ppmw) PMP | Additive Oil | Ratio PHGE:PAO (w/w) in Additive Oil | Compression pressure |
|---|---|---|---|---|
| Example 11 | 600 | 1050 | 1:1 | 13.1 |
| Comp. I | 600 | 1500 | 1:0 | 3:3 |
| Example 12 | 600 | 1500 | 4:1 | 13.3 |
| Example 13 | 600 | 1500 | 1.5:1 | 13.5 |
| Example 14 | 600 | 1500 | 1:1.5 | 12.1 |
| Example 15 | 600 | 1500 | 1:4 | 13.8 |
| Comp. J | 600 | 1500 | 0:1 | 10.3 |
| Example 16 | 750 | 1200 | 1:1 | 11.1 |
| Comp. K | 750 | 1500 | 1:0 | 3.8 |
| Example 17 | 750 | 1500 | 4:1 | 7.4 |
| Example 18 | 750 | 1500 | 1.5:1 | 12.9 |
| Example 19 | 750 | 1500 | 1:1.5 | 10.4 |
| Example 20 | 750 | 1500 | 1:4 | 13.3 |
| Comp. L | 750 | 1500 | 0:1 | 13.5 |
| Comp. M | 900 | 900 | 1:0 | 0.5 |
| Example 21 | 900 | 900 | 1.5:1 | 13.3 |
| Example 22 | 900 | 900 | 1:1 | 13.8 |
| Comp. N | 900 | 900 | 0:1 | 13.4 |
| Comp. O | 900 | 1200 | 1:0 | 3.5 |
| Example 23 | 900 | 1200 | 1:1 | 13.0 |
| Comp. P | 900 | 1200 | 0:1 | 11.8 |

Those skilled in the art will appreciate that the above concentrations represent three times normal commercial concentrations in order to increase test severity.

The above results show that when the additive oil is a combination of PHGE and PAO, the compression pressure result is very good, always significantly superior to PHGE alone, significantly better than would be predicted for intermediate values between those for PHGE alone and PAO alone, and generally comparable with, and sometimes even superior to those for PAO alone.

Examples 24 to 47

The effect of gasoline composition on engine inlet system deposits was assessed by induction system deposit simulator (ISD) testing. In this test method, a gasoline composition was metered to a spray nozzle from which it was expelled in a flat spray pattern onto the surface of an aluminum tube heated to 250° C. The base gasoline used incorporated aged thermally cracked gasoline, in order to encourage formation of deposits. Under the test conditions, such base gasolines alone form a central carbonaceous deposit on the tube surface. Cleanliness-promoting agents prevent deposition in the central area and result in a ring-like deposit on the tube. Residue formation is assessed visually according to the following scale:

0—clean
1–2—nearly clean
3–4—slightly coked
5–6—medium coked
7–8—medium to heavily coked
9–10—heavily coked
over 10—very heavily coked In a similar manner to Table III, results of the ISD testing are given in Table IV:

TABLE IV

| Test No. | Concentrations (ppmw) PMP | Additive Oil | Ratio PHGE:PAO in Additive Oil | ISD Rating |
|---|---|---|---|---|
| Example 24 | 100 | 175 | 1:1 | 6 |
| Example 25 | 100 | 200 | 1:1 | 4 |
| Comp. Q | 100 | 250 | 1:0 | 5 |
| Example 26 | 100 | 250 | 4:1 | 6 |
| Example 27 | 100 | 250 | 1.5:1 | 7 |
| Example 28 | 100 | 250 | 1:1.5 | 6 |
| Example 29 | 100 | 250 | 1:4 | 6 |
| Comp. R | 100 | 250 | 0:1 | 14 |
| Comp. S | 125 | 250 | 1:0 | 3 |
| Example 30 | 125 | 250 | 4:1 | 3 |
| Example 31 | 125 | 250 | 1.5:1 | 4 |
| Example 32 | 125 | 250 | 1:1.5 | 7 |
| Example 33 | 125 | 250 | 1:4 | 6 |
| Comp. T | 125 | 250 | 0:1 | 14 |
| Comp. U | 150 | 150 | 1:0 | 2 |
| Example 34 | 150 | 150 | 1:1 | 3 |
| Comp. V | 150 | 150 | 0:1 | 12 |
| Comp. W | 150 | 200 | 1:0 | 4 |
| Example 35 | 150 | 200 | 1:1 | 3 |
| Comp. X | 150 | 200 | 0:1 | 12 |
| Example 36 | 200 | 350 | 1:1 | 3 |
| Comp. Y | 200 | 500 | 1:0 | 2 |
| Example 37 | 200 | 500 | 4:1 | 1 |
| Example 38 | 200 | 500 | 1.5:1 | 2 |
| Example 39 | 200 | 500 | 1:1.5 | 3 |
| Example 40 | 200 | 500 | 1:4 | 4 |
| Comp. Z | 200 | 500 | 0:1 | 9 |
| Example 41 | 250 | 400 | 1:1 | 3 |
| Comp. AA | 250 | 500 | 1:0 | 1 |
| Example 42 | 250 | 500 | 4:1 | 1 |
| Example 43 | 250 | 500 | 1.5:1 | 2 |
| Example 44 | 250 | 500 | 1:1.5 | 3 |
| Example 45 | 250 | 500 | 1:4 | 3 |
| Comp. BB | 250 | 500 | 0:1 | 6 |

TABLE IV-continued

| Test No. | Concentrations (ppmw) PMP | Additive Oil | Ratio PHGE:PAO in Additive Oil | ISD Rating |
|---|---|---|---|---|
| Comp. CC | 300 | 300 | 1:0 | 1 |
| Example 46 | 300 | 300 | 1:1 | 2 |
| Comp. DD | 300 | 300 | 0:1 | 7 |
| Comp. EE | 300 | 400 | 1:0 | 1 |
| Example 47 | 300 | 400 | 1:1 | 3 |
| Comp. FF | 300 | 400 | 0:1 | 7 |

The results in Table IV show that when the additive oil is a combination of PHGE and PAO, the ISD rating is generally good, always superior to PAO alone, significantly better than would be predicted for intermediate values between those for PHGE alone and PAO alone, and generally comparable with those for PHGE alone.

In conclusion, it can be noted that additive concentrates containing both PHGE and PAO had good storage stability, by comparison with similar concentrates containing PHGE but not PAO; inlet valve deposits were found to be lower in gasolines containing additive oil in the form of a combination of PHGE and PAO compared with those in which the additive oil was solely PHGE or PAO; avoidance of valve sticking, as evidenced by compression pressure assessment, was significantly superior for combinations of PHGE and PAO than for PHGE alone, and generally comparable to PAO alone; and avoidance of deposit formation, as evidenced by ISD testing, was significantly superior for combinations of PHGE and PAO than for PAO alone, and generally comparable to PHGE alone.

What is claimed is:

1. A gasoline composition comprising a major amount of gasoline suitable for use in spark-ignition engines, a minor amount of polyalphaolefin having a viscosity at 100° C. from about $2\times10^{-6}$ $m^2/s$ to about $2\times10^{-5}$ $m^2/s$ (2 to 20 centistokes), being a hydrogenated oligomer containing from 18 carbon atoms to 80 carbon atoms derived from at least one alphaolefinic monomer containing from 8 carbon atoms to 16 carbon atoms, a minor amount of a polyoxyalkylene compound having the formula I:

$$R^1—O(R—O)_nR^2$$

wherein $R^1$ and $R^2$ independently represent hydrogen atoms or $C_{1-40}$ hydrocarbyl groups, each R independently represents a $C_{2-8}$ alkylene group and n is such that the Mn of the polyoxyalkylene compound is from about 700 to about 2000, and a minor amount of a hydrocarbon-soluble ashless dispersant comprising a polyolefin-substituted succinimide derivative wherein the polyolefin has a Mn from about 800 to about 5000, the weight ratio of polyalphaolefin:polyoxyalkylene compound being from about 1:5 to about 5:1.

2. The gasoline composition of claim 1 wherein the polyalphaolefin and the polyoxyalkylene compound together are present in an amount from about 100 ppmw to about 1200 ppmw, based on the total composition.

3. The fuel composition of claim 2 wherein the polyalphaolefin is derived from an alphaolefinic monomer containing from 8 carbon atoms to 12 carbon atoms.

4. The gasoline composition of claim 3 wherein the polyalphaolefin has a viscosity at 100° C. from about $6\times10^{-6}$ $m^2/s$ to about $1\times10^{-5}$ $m^2/s$ (6 to 10 centistokes).

5. The gasoline composition of claim 1 wherein $R^1$ represents a $C_{8-20}$ alkyl group and $R^2$ represents a hydrogen atom.

6. The gasoline composition of claim 1 wherein each R independently represents a $C_{2-4}$ alkylene group.

7. The gasoline composition of claim 6 wherein the polyalphaolefin and the polyoxyalkylene compound together are present in an amount from about 100 ppmw to about 1200 ppmw based on the total composition.

8. The gasoline composition of claim 1 wherein the ashless dispersant is present in an amount from about 30 ppmw to about 500 ppmw based on the total composition.

9. A concentrate suitable for addition to a gasoline composition which comprises a gasoline -compatible diluent, a polyalphaolefin having a viscosity at 100° C. from about $2\times10^{-6}$ $m^2/s$ to about $2\times10^{-5}$ $m^2/s$ (2 to 20 centistokes), being a hydrogenated oligomer containing from 18 carbon atoms to 80 carbon atoms derived from at least one alphaolefinic monomer containing from 8 carbon atoms to 16 carbon atoms, a polyoxyalkylene compound having the formula I:

$$R^1—O(R—O)_nR^2$$

wherein $R^1$ and $R^2$ independently represent hydrogen atoms or $C_{1-40}$ hydrocarbyl groups, each R independently represents a $C_{2-8}$ alkylene group and n is such that the Mn of the polyoxyalkylene compound is from about 700 to about 2000, and a minor amount of a hydrocarbon-soluble ashless dispersant comprising a polyolefin-substituted succinimide derivative wherein the polyolefin has a Mn from about 800 to about 5000, the weight ratio of polyalphaolefin:polyoxyalkylene compound being from about 1:5 to about 5:1.

10. The concentrate of claim 9 wherein the polyalphaolefin and the polyoxyalkylene compound together are present in an amount from about 20% w to about 80% w and the ashless dispersant is present in an amount from about 5% w to about 30% w, all percentages being calculated on the diluent.

11. A method of operating a spark-ignition internal combustion engine which comprises introducing into the combustion chambers of said engine a gasoline composition comprising a major amount of gasoline suitable for use in spark-ignition engines, a minor amount of a polyalphaolefin having a viscosity at 100° C. from about $2\times10^{-6}$ $m^2/s$ to about $2\times10^{-5}$ $m^2/s$ (2 to 20 centistokes), being a hydrogenated oligomer containing from 18 carbon atoms to 80 carbon atoms derived from at least one alphaolefinic monomer containing from 8 carbon atoms to 16 carbon atoms, a minor amount of a polyoxyalkylene compound having the formula I:

$$R^1—O(R—O)_nR^2$$

wherein $R^1$ and $R^2$ independently represent hydrogen atoms or $C_{1-40}$ hydrocarbyl groups, each R independently represents a $C_{2-8}$ alkylene group and n is such that the Mn of the polyoxyalkylene compound is from about 700 to about 2000, and a minor amount of a hydrocarbon-soluble ashless dispersant comprising a polyolefin-substituted succinimide derivative wherein the polyolefin has a Mn from about 800 to about 5000, the weight ratio of polyalphaolefin:polyoxyalkylene compound being from about 1:5 to about 5:1.

* * * * *